US006854945B2

(12) United States Patent
Humphrey et al.

(10) Patent No.: US 6,854,945 B2
(45) Date of Patent: Feb. 15, 2005

(54) DRIFT PIN CAP AND METHOD OF USING SAME

(76) Inventors: John Humphrey, 712 North St., Walnut, IA (US) 51577; Dean Wieser, 807 Hickory St., Atlantic, IA (US) 50022

( * ) Notice: Subject to any disclaimer, the term of this patent is extended or adjusted under 35 U.S.C. 154(b) by 0 days.

(21) Appl. No.: 10/301,773

(22) Filed: Nov. 21, 2002

(65) Prior Publication Data

US 2003/0095849 A1 May 22, 2003

Related U.S. Application Data

(60) Provisional application No. 60/331,940, filed on Nov. 21, 2001.

(51) Int. Cl.[7] ..... E16B 15/02

(52) U.S. Cl. ..... 411/481; 411/480; 411/498; 411/469; 144/195.7; 29/275

(58) Field of Search ..... 411/480, 481, 411/337, 482, 498, 469; 144/195.7; 33/645; 29/271, 275

(56) References Cited

U.S. PATENT DOCUMENTS

| | | | | | |
|---|---|---|---|---|---|
| 2,314,582 | A | * | 3/1943 | Gerich | 407/1 |
| 2,370,017 | A | * | 2/1945 | Delvaux | 29/271 |
| 2,484,801 | A | * | 10/1949 | Anderson | 33/644 |
| 3,389,472 | A | * | 6/1968 | Poland | 33/520 |
| 3,595,592 | A | * | 7/1971 | Wagner | 279/47 |
| 3,627,220 | A | * | 12/1971 | Vogel | 242/613.5 |
| 3,685,126 | A | * | 8/1972 | Kane | 29/254 |
| 4,492,329 | A | * | 1/1985 | Benson et al. | 227/10 |
| 4,982,489 | A | * | 1/1991 | Haugen | 29/402.01 |
| 5,590,474 | A | * | 1/1997 | Lamb | 33/645 |
| 5,916,338 | A | * | 6/1999 | Bergkvist et al. | 81/22 |
| 5,996,442 | A | * | 12/1999 | Carmien | 81/25 |
| 6,202,315 | B1 | * | 3/2001 | Schmick, Jr. | 33/290 |

FOREIGN PATENT DOCUMENTS

JP 2001322073 A * 11/2001 ..... B25D/3/00

OTHER PUBLICATIONS

"UHMW Polyethylene", from www.wps.on.ca/technical/html/Industrial/uhmw–polyethylene.htm, undated.3 pages.*

Quadrant Engineering Plastics Brochure, downloaded from www.quadrantplatics.com/download/GPPP.uk.pdf, see p. "9" of 14 pages printed of 17 page brochure, Jan. 1, 2002 or earlier.*

* cited by examiner

*Primary Examiner*—J J Swann
*Assistant Examiner*—Katherine Mitchell
(74) *Attorney, Agent, or Firm*—Adam H. Jacobs

(57) ABSTRACT

In combination, an elongated tool having a striking end and a tapered insertion end and a drift pin cap. The drift pin cap includes a cap body having an upper end, a lower end and at least one side wall extending between and connecting the upper end and the lower end. A drift pin receiving cavity is formed in the lower end of the cap body which extends upwards towards the upper end within the cap body, the pin receiving cavity having a diameter smaller than a diameter of the cap body. The pin receiving cavity is operative to fit over and be retained on the striking end of the tool such that when the tool is impacted by a driving device, the drift pin cap is interposed between the tool and the driving device to prevent damage to the tool yet still permit driving of the tool.

6 Claims, 3 Drawing Sheets

DRIFT PIN CAP AND METHOD OF USING SAME

CROSS-REFERENCE TO RELATED APPLICATION

This application claims priority to the filing date of a related provisional application Ser. No. 60/331,940 filed Nov. 21, 2001.

BACKGROUND OF THE INVENTION

1. Technical Field

The present invention is directed to devices and methods associated with the striking and driving of drift pins, stakes, rods, or the like and, more particularly, to a drift pin cap and method of using same including a hardened plastic cap having a drift pin insertion end, the end having a pin receiving cavity, and a striking end that is generally flat whereby a hammer or driving device may impact the drift pin cap without damaging the drift pin and allowing for more efficient driving of the drift pin into the joint bars thereby aligning the rail holes and track.

2. Description of the Prior Art

There are hundreds of thousands of miles of railroad track across the United States and throughout the world, and new construction and maintenance of railroad tracks is an ongoing concern. Increasing demand for rail transport requires the construction of new track and due to the constant wear and tear on the track, replacement of track sections is often necessary. In either case, the connections between rail sections are made by a series of joint bars which align with the transverse holes formed adjacent the ends of the rail sections. These holes need to be aligned in order to permit the rail sections to be joined to one another, and the common method by which this is done is to drive a "drift pin" into the two holes to align them prior to insertion of the rail pin connector. A drift pin is a generally cylindrical metal bar having a flat striking end and a tapered insertion end, the insertion end being placed within the holes to be aligned and the striking end being impacted by a hammer or the like to drive the drift pin into the holes thus aligning them for insertion of a rail pin connector. In fact, it should be noted that drift pins are used in many different situations for aligning two holes in two objects for insertion of a pin, bolt or other fastener, not just in the railroad industry.

One of the major problems in the industry of driving drift pins are the injuries operators incur due to the impact of the driving device onto the drift pin and the subsequent shrapnel that is dislodged. Thousands of man-hours are lost every year due to such injuries. In the past, the operator would impact the drift pin with the driving device such as a sledge hammer and the metal of the drift pin would very often become dislodged at high velocity and impact the operator resulting in injuries and the inevitable missing of work. One way the prior art has attempted to solve this problem was through the use of metal or rubber caps that would prevent metal from being dislodged from the drift pin. However, the prior art was problematic in that the rubber caps would disintegrate upon impact and the result would be the same metal shrapnel as before. The metal caps were even more dangerous as they tended to become deformed upon impact and the metal from the cap could, itself, become shrapnel resulting in injuries to the operator. There is therefore a need for a device which will prevent the creation of shrapnel resulting from the striking of the drift pin with the driving device.

Another problem encountered with the prior art is that the striking ends of the drift pins often become splayed or deformed after extended use due to the repeated impact of the driving device onto the striking end. The resulting damage to the drift pin can eventually render the pin unusable and thus requires replacement of the drift pin. As drift pins can be expensive, there is a need for a device which will act to prevent splaying or deformation of the drift pin striking end, thus increasing the usable lifespan of the drift pin.

Therefore, an object of the present invention is to provide an improved drift pin cap and method of using same.

Another object of the present invention is to provide a drift pin cap and method of using same which includes a cap body having a drift pin receiving cavity formed in the lower end of the cap body and extending upwards towards the upper end within the cap body.

Another object of the present invention is to provide a drift pin cap and method of using same which will prevent the destruction of the drift pin by impact by the driving device by interposing the cap between the drift pin and the driving device.

Another object of the present invention is to provide a drift pin cap and method of using same which will prevent the creation of shrapnel resulting from the striking of the drift pin with the driving device.

Finally, an object of the present invention is to provide a drift pin cap and method of using same which is relatively simple to manufacture and is safe, durable and efficient in use.

SUMMARY OF THE INVENTION

The present invention provides a combination of an elongated tool having a striking end and a tapered insertion end and a drift pin cap. The drift pin cap includes a cap body having an upper end, a lower end and at least one side wall extending between and connecting the upper end and the lower end. A drift pin receiving cavity is formed in the lower end of the cap body which extends upwards towards the upper end within the cap body, the pin receiving cavity having a diameter smaller than a diameter of the cap body. The pin receiving cavity is operative to fit over and be retained on the striking end of the tool such that when the tool is impacted by a driving device, the drift pin cap is interposed between the tool and the driving device to prevent damage to the tool.

The method of using the drift pin cap in connection with the drift pin includes the steps of providing an elongated drift pin having a striking end and a tapered insertion end and providing a drift pin cap including a cap body having an upper end, a lower end and at least one side wall extending between and connecting the upper end and the lower end and a drift pin receiving cavity formed in the lower end of the cap body and extending upwards towards the upper end within the cap body, the pin receiving cavity having a diameter smaller than a diameter of the cap body. The drift pin cap is placed over the striking end of the elongated drift pin with the striking end extending into the pin receiving cavity and being retained therein and the insertion end of the elongated drift pin is placed into a hole to be aligned with another hole. The elongated drift pin is driven into the hole by impact of a driving device with the drift pin cap mounted on the elongated drift pin and splaying of and emission of shrapnel from the elongated drift pin is prevented via the drift pin cap.

It is clear that the features of this invention combine to form an easily used and extremely durable and efficient drift pin cap and method of using same. The drift pin cap is quickly and easily applied to any different drift pin and in fact may be used in connection with many different typed of devices such as stakes, spikes, dowels, chisels, wedges or the like which are to be driven into a plurality of substrates such as dirt, concrete, gravel, or like substrates. Furthermore, the polyethylene component of the present invention is found to be superior to other materials used in the industry and in fact has not been used in this manner or for this purpose. It has been found, however, that it is particularly well-suited for uses described by this invention. Finally, the prevention of splaying of and emission of shrapnel from the elongated drift pin has not been accomplished by the prior art, yet the present invention not only achieves this goal, but provides a safe and easily used apparatus and method by which to do so. It is thus seen that the present invention provides a substantial improvement over the prior art.

DESCRIPTION OF THE PREFERRED EMBODIMENT

Figure 1:
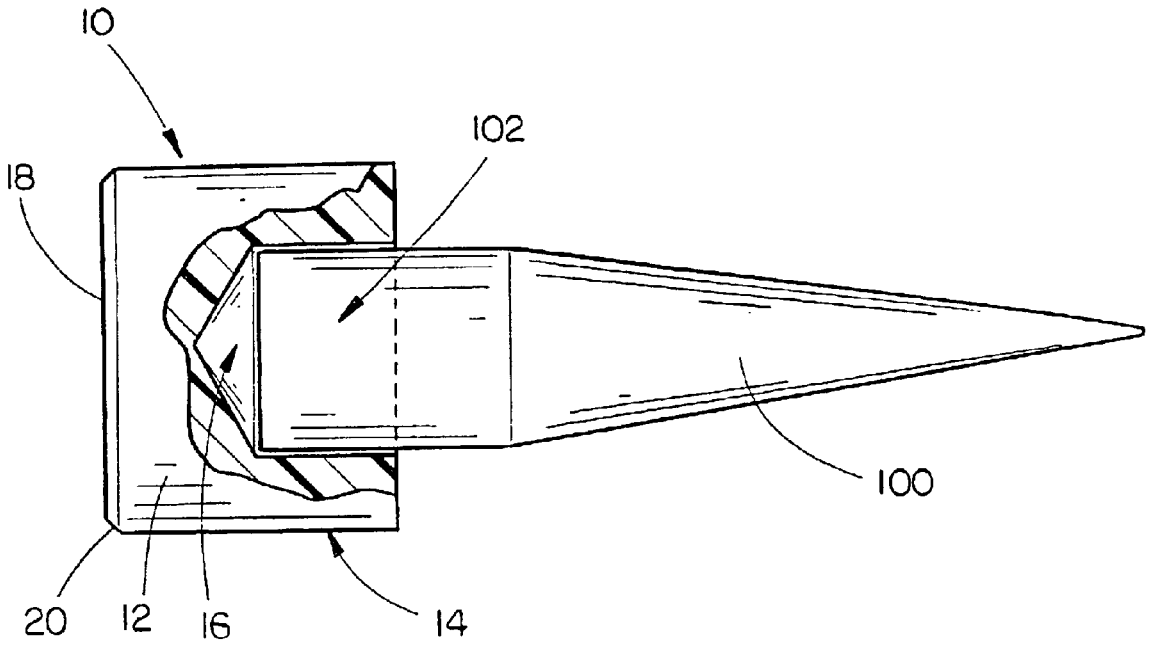
FIG. 1 is a detail side elevational view of a first preferred embodiment of the present invention.
Figure 2:
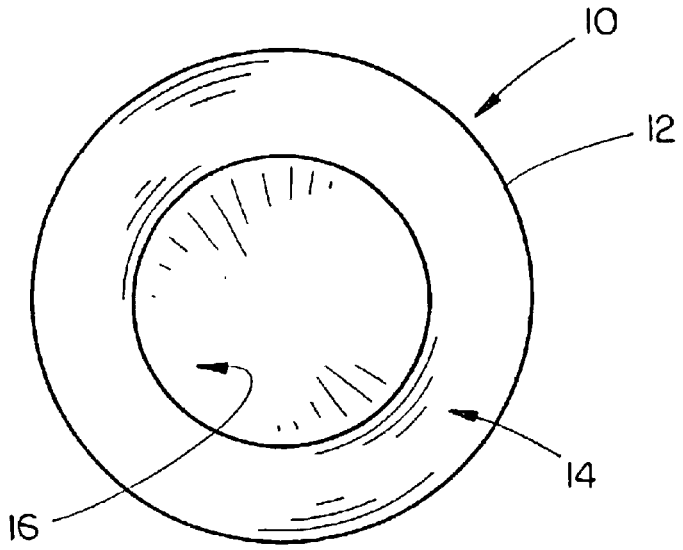
FIG. 2 is a bottom plan view of the embodiment of FIG. 1.

The drift pin cap 10 of the present invention is best shown in FIGS. 1 and 2 as including a generally cylindrical cap body 12 having a height of approximately two to three inches (2" to 3") and an outer diameter of approximately two and one-half inches (2½"). In the preferred embodiment the drift pin cap 10 would be constructed of UHMW polyethylene ("UHMW"). UHMW is a lightweight and long wearing polyethylene material that is ideal for this particular application and although the friction-reducing properties of the material have been known, the use of the material in the apparatus and method of the present invention has not been taught or suggested to the inventor's knowledge. The UHMW material has additional properties which lend themselves to use in the present invention, such as it being relatively easy to work with, i.e. requires no special handling techniques, and can be manufactured to meet the shapes and sizes which are preferred in the present invention. Ultra High Molecular Weight Polyethylene (UHMW) is light weight (⅛ the weight of mild steel), high in tensile strength, and as simple to machine as wood. UHMW is self-lubricating, shatter resistant, long-wearing, abrasion and corrosion resistant. Of course, there may be other such durable and easily worked materials with similar splaying, fracturing, and splintering preventing qualities which are not presently known, but are to be understood as being included in the present disclosure.

The lower end of the cap body 12 of the drift pin cap 10 is referred to as the pin insertion end 14. Formed adjacent to the pin insertion end 14 and extending into the cap body 12 is a pin receiving cavity 16. The pin receiving cavity 16 is formed by boring a polygonal, cylindrical, hemispherical, rectangular, square or triangular hole into the cap body 12 approximately one to two inches (1" to 2") in depth and approximately one and one-half inches (1½") in diameter, depending on the diameter and shape of the striking end of the drift pin. The pin receiving cavity 16 is of generally smaller diameter than that of the cap body 12 and would preferably be formed via the use of a drill bit or like device, although it may be formed by injection molding process or other such production methods, any of which would be suitable for use with the present invention. The operation of the pin receiving cavity 16 may be understood upon reference to FIGS. 1 and 2 in which the pin receiving cavity 16 accepts the upper end 102 of the drift pin 100 and the diameter of the pin receiving cavity 16 creates a tight fit around the upper end 102 of the drift pin 100 thus preventing the drift pin cap 10 from becoming dislodged upon impact of the driving device such as a sledge hammer (not shown). Of course, the drift pin 100 shown in FIG. 1 is not drawn to scale and should be understood to be only representative of the placement of the drift pin cap 10 on the drift pin 100.

Located at the upper end of the cap body 12 of the drift pin cap 10 is the striking surface 18. In the preferred embodiment, the striking surface 18 is a generally flat surface adapted for receiving impact from a driving device and transferring the impact force through the drift pin cap body 12 into the drift pin 100 thereby driving the drift pin into the holes on the joint bar (not shown) and aligning the rail holes (not shown). Although FIG. 1 shows the striking surface 18 as being generally smooth and flat, it should be noted that the striking surface 18 may be slightly rounded or may be pebbled, scored or the like resulting in increased friction between the driving device and the striking surface 18.

Formed between the striking surface 18 and the cap body 12 is an upper circumferential chamfer 20. The upper circumferential chamfer 20 is approximately one-sixteenth inches (1/16") in width and is formed through beveling or sanding the edge formed between the striking surface 18 and the cap body 12 thereby decreasing the angle between the striking surface 18 and the outer side wall of the cap body 12. The upper circumferential chamfer 20 improves upon the prior art in that the upper circumferential chamfer 20 will decrease the amount of damage to the drift pin cap 10 resulting from an off-center strike by the driving device upon the striking surface 18.

Figure 4:
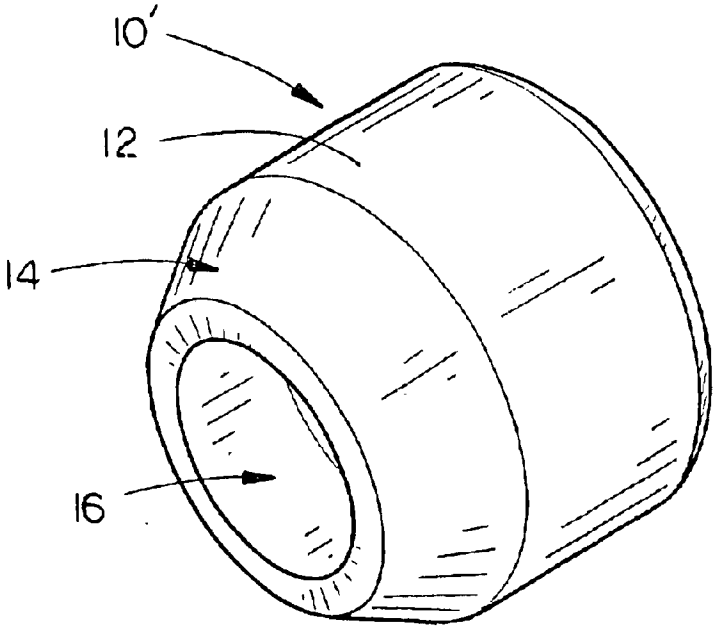
FIG. 4 is a bottom plan view of the embodiment of FIG. 3.
Figure 3:
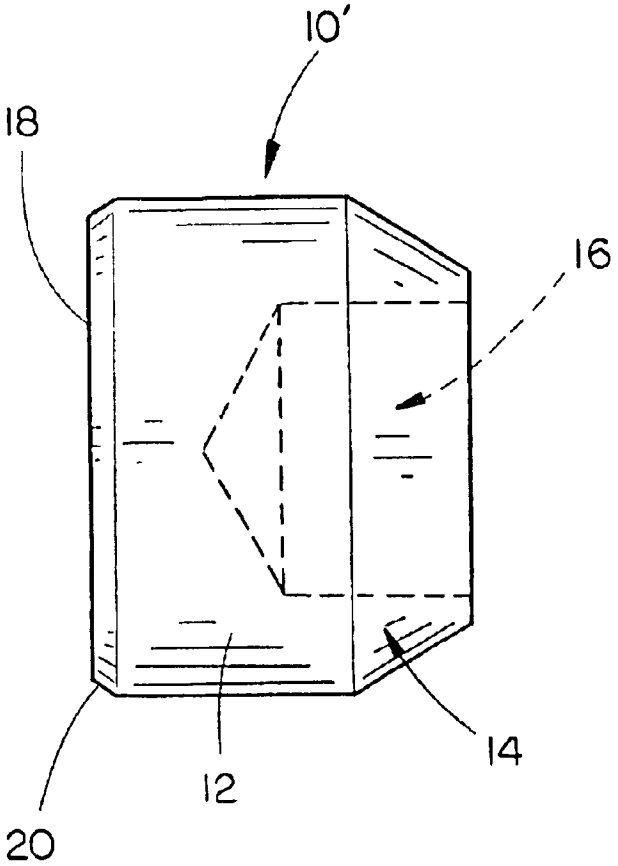
FIG. 3 is a detail side elevational view of a second preferred embodiment of the present invention.

FIGS. 3 and 4 disclose a second preferred embodiment of the present invention. In this embodiment, the pin insertion end 14 of the drift pin cap 10' is tapered and the tapered portion is approximately five-eights inches (⅝") in length. The tapered portion of the pin insertion end 14 permits additional distortion of the side wall of the drift pin cap 10' to facilitate a snugger fit of the drift pin cap 10' on the drift pin 100.

Figure 5:
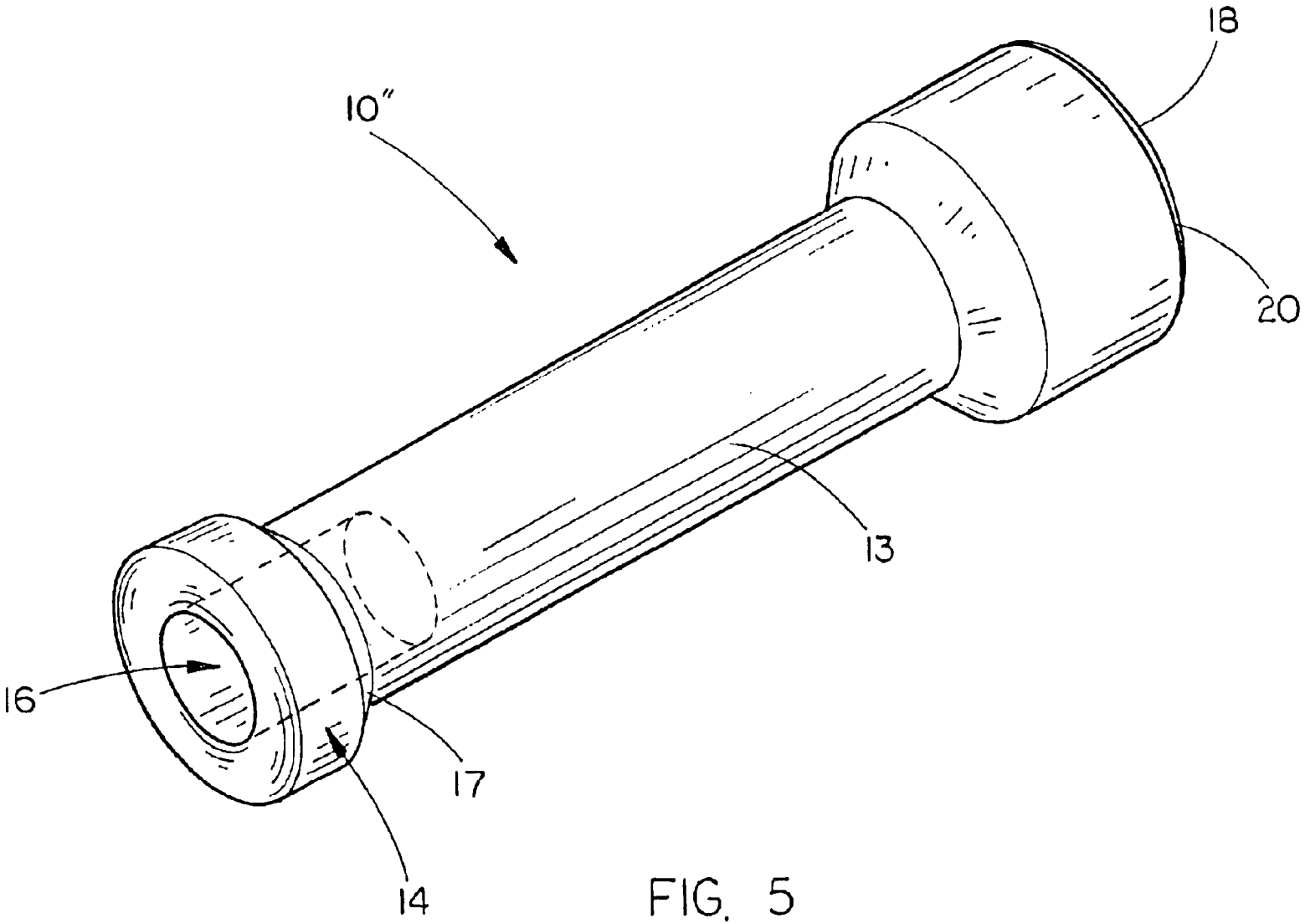
FIG. 5 is a detail perspective view of a third preferred embodiment of the present invention.

FIG. 5 represents a third preferred embodiment of the present invention. In the embodiment of FIG. 5, the drift pin cap 10" has a height of approximately seven inches (7") and further includes a cap neck 13 formed between and connecting the pin insertion end 14 and the striking surface 18 of the drift pin cap 10". The cap neck 13 is approximately three inches (3") in height and has a diameter of approximately two and one-half inches (2½"). The cap neck 13 allows the operator to easily grasp and manipulate the drift pin cap 10" and drift pin 100.

Adjacent to and below the cap neck 13 is the pin insertion end 14. In this embodiment, the pin insertion end 14 is preferably a circumferential bulbous ring of approximately one inch (1") in height, approximately three inches (3") in diameter, and would include a connecting shoulder 17 between cap neck 13 and pin insertion end 14 which extends at an angle of approximately one hundred degrees (100°).

Formed adjacent to the pin insertion end 14 and extending into the cap neck 13 is the pin receiving cavity 16. The pin receiving cavity 16 in this embodiment is deeper than in the previous embodiments due to the elongated cap neck 13. The pin receiving cavity 16 is formed as per the previous embodiments, via drilling or manufacture, but the length of the cap neck 13 allows for a deeper hole, approximately three inches (3"), creating the pin receiving cavity 16. The pin receiving cavity 16 of this embodiment can, therefore, accept a longer portion of the upper end 102 of the drift pin 100 thereby increasing the stability of the drift pin cap 10 on the drift pin 100.

On the upper end of the cap neck 13 is formed the cap head 17. The cap head is approximately two inches (2") in height and has a diameter of approximately three inches (3"). Atop the cap head 17 is the generally flat striking surface 18. The cap head 17 creates a striking surface 18 that is approximately less than three inches (3") when the circumferential chamfer 20 is formed.

The method of the present invention is generally as follows. The operator of the device would first position the drift pin cap 10 atop the drift pin 102 inserting the upper end 102 of the drift pin 102 into the pin receiving cavity 16 thereby forming a snug fit between the upper end 102 of the drift pin 100 and the pin receiving cavity 16. The operator would place the drift pin cap 10 and drift pin 102 in the desired position aligning the drift pin 100 within the joint bar holes into which the drift pin 100 is to be driven. The operator would then swing a driving device such as a sledgehammer as to impact the striking surface 18 of the drift pin cap 10 and drive the drift pin 100 into the holes on the joint bar thereby aligning the holes in the rails (not shown). The operator would impact the striking surface 18 of the drift pin cap 10 as many times as necessary to align the rail holes. The operator would remove the drift pin 100 and drift pin cap 10 from the joint bar and rail holes and insert the track fastening device (not shown).

The present invention is composed of polyethylene which is superior to the metal in that the polyethylene is not as malleable and does not deform to the extent of metal. The rigidity of the polyethylene and the upper circumferential chamfer 20 of the drift pin cap 10 prevents even an off-center impact upon the striking surface 18 from damaging the drift pin cap 10. As a result, the drift pin cap 10 will prevent the collision between the driving device and the metal drift pin thus resulting in no shrapnel being emitted which could injure the operator. Likewise, the drift pin cap 10 does not disintegrate like the rubber used in caps in the prior art. The drift pin cap 10 will remain in its general form thus eliminating the contact between the driving device and the drift pin resulting in little or no shrapnel.

Another improvement the current invention displays over the prior art is its recoil preventing qualities due to its polyethylene composition. The present invention absorbs the energy created by the driving device impacting the striking surface 18 thereby lessening the recoil that has been seen in the rubber and metal materials used in the prior art. As a result of the recoil preventing qualities the operator is at less risk of becoming injured due to recoil of the driving device.

The shape and design of the present invention also decreases the possibility of the cap 10 becoming dislodged and causing injury to the operator. The pin receiving cavity 16 of the drift pin cap 10, as seen in FIGS. 1 and 2, is created as to fit snugly around the upper end 102 of the drift pin 100 thus decreasing the possibility of the drift pin cap 10 from becoming dislodged. In fact, it is intended that the drift pin cap 10 will remain snugly atop the drift pin 100 during the useful life of the drift pin 100. Additionally, the outer diameter of the drift pin cap 10 can protect an operator's hands from being struck by the driving device. The operator may place his hand under the pin insertion end 14 of the present invention and the diameter of the drift pin cap 10 will partially protect the hand by deflecting the driving device.

It is to be understood that numerous modifications, additions, and substitutions may be made to the present invention which are intended to fall within the broad scope of the above description. For example, the exact shape, size, and construction materials used in the present invention may be modified and/or changed so long as the functionality of the invention is not impaired or degraded. Additionally, the broad scope of the present invention is contemplated to cover its use in conjunction with other applications. For example, the present invention may be modified to fit stakes, spikes, dowels, chisels, wedges or the like to be driven in a plurality of substrates such as dirt, concrete, gravel, or like substrates. In fact, although the present invention has been described as a "drift pin cap", it should be noted that it will likely be referred to in connection with whatever tool it is being used with, for example, if it were to be used with a wedge, it might be referred to as a "wedge cap," a "stake cap" if used with a stake, and so on. In such applications, it may be necessary to attach the cap to the tool by a strap or clamp, or by gluing or epoxying the cap thereto, although such application would be understood by one skilled in the prior art. Furthermore, the polyethylene component of the present invention is found to be superior to other materials used in the industry and is particularly well-suited for uses described by this invention.

There has therefore been shown and described a drift pin cap and method for using same 10 which accomplishes at least all of its intended purposes.

We claim:

1. In combination:

an elongated tool having a striking end and a tapered insertion end; and a drift pin cap comprising;

a cap body having an upper end, a lower end and at least one side wall extending between and connecting said upper end and said lower end, said cap body formed as an integral unit consisting of a generally rigid impact-resistant polyethylene material;

a drift pin receiving cavity formed in said lower end of said cap body and extending upwards towards said upper end within said cap body, said pin receiving cavity having a diameter smaller than a diameter of said cap body and being operative to fit over and be retained on said striking end of said tool;

said drift pin receiving cavity having a diameter slightly less than the diameter of said striking end of said tool such that placement of said drift pin receiving cavity over said striking end of said tool requires slight deformation of said drift pin can thereby creating a strong frictional bond between said drift pin receiving cavity and said striking end of said tool thereby frictionally retaining said drift pin can on said tool;

said drift pin cap being free of impact-reducing mechanical devices such that said drift pin can is reliant on its construction material for impact reduction.

2. The drift pin cap of claim 1 wherein said generally rigid polyethylene material is Ultra High Molecular Weight (UHMW) polyethylene.

3. The drift pin cap of claim 1 wherein said upper end of said cap body is the striking surface of said cap body, said cap body further comprising a chamfer extending circumferentially around said striking surface interposed between said striking surface and said at least one side wall thereby decreasing the angle formed between said striking surface and said at least one side wall thus decreasing the amount of damage to said drift pin cap resulting from an off-center strike by a driving device upon said striking surface.

4. The drift pin cap of claim 1 wherein said at least one side wall is tapered inwards on the lower portion thereof to said lower end thereby permitting additional distortion of said at least one side wall of said drift pin cap to facilitate a snugger fit of said drift pin cap on said tool.

5. The drift pin cap of claim 1 wherein said tool is selected from the group comprising a drift pin, a stake, a spike, a dowel, a chisel and a wedge.

6. A drift pin cap for application to an elongated tool having a striking end and a tapered insertion end, said drift pin cap comprising;

a cap body having an upper end, a lower end and at least one side wall extending between and connecting said upper end and said lower end, said cap body formed as an integral unit consisting of a generally rigid impact-resistant polyethylene material;

a drift pin receiving cavity formed in said lower end of said cap body and extending upwards towards said upper end within said cap body, said pin receiving cavity having a diameter smaller than a diameter of said cap body and being operative to fit over and be retained on a striking end of a tool;

said drift pin can being free of impact-reducing mechanical devices such that said drift yin cap is reliant on its construction material for impact reduction.

* * * * *